US005213214A

United States Patent [19]

Stringham

[11] Patent Number: 5,213,214

[45] Date of Patent: May 25, 1993

[54] CONFECTION/GIFT HOLDING AND LID STRUCTURE FOR USE IN ENVELOPES

[76] Inventor: Richard B. Stringham, 522 E. First South, Salt Lake City, Utah 84102

[21] Appl. No.: 943,440

[22] Filed: Sep. 9, 1992

[51] Int. Cl.[5] ..... B65D 1/36

[52] U.S. Cl. ..... 206/564; 206/587; 206/592; 206/815; 229/904.1; 229/68 R; 220/555

[58] Field of Search ..... 220/555; 206/72, 61, 206/1.8, 564, 571, 908, 587, 592, 815; 229/68 R, 904.1

[56] References Cited

U.S. PATENT DOCUMENTS

| | | | |
|---|---|---|---|
| 3,305,086 | 2/1967 | Hartman, Jr. | 206/592 |
| 4,533,049 | 8/1985 | Ozeki | 206/564 X |
| 4,887,790 | 12/1989 | Wilkinson et al. | 220/555 X |
| 5,046,616 | 9/1991 | Makowski et al. | 206/564 X |
| 5,052,560 | 10/1991 | Stringham | 206/564 |

FOREIGN PATENT DOCUMENTS

| | | | |
|---|---|---|---|
| 1112007 | 7/1961 | Fed. Rep. of Germany | 229/904.1 |
| 928113 | 6/1963 | United Kingdom | 206/564 |

*Primary Examiner*—Steven M. Pollard
*Attorney, Agent, or Firm*—Thorpe, North & Western

[57] ABSTRACT

A confection/gift holding structure for disposition in greeting cards and greeting card envelopes includes a base constructed of a generally planar sheet of material having a plurality of relatively shallow recesses formed in one surface thereof to define open receptacles for receiving and holding confections, where such confections have thicknesses and parametric shapes which generally conform to the depths and shapes of corresponding receptacles. A channel is also formed in said one surface of the sheet of material at a location to circumscribe the recesses, with the channel having facing sidewalls and notches formed in at least one of the sidewalls and spaced apart about the channel. A generally flexible planar lid is also provided, where the perimeter of the lid is formed to overlie the channel when the lid is placed on the base. The lid includes a lip projecting downwardly from the perimeter to fit in the channel and allow the lid to lie flat on the one surface of the base. The lip includes laterally projecting tabs which fit into respective notches in the channel to hold the lid in place on the base.

16 Claims, 1 Drawing Sheet

Fig. 1
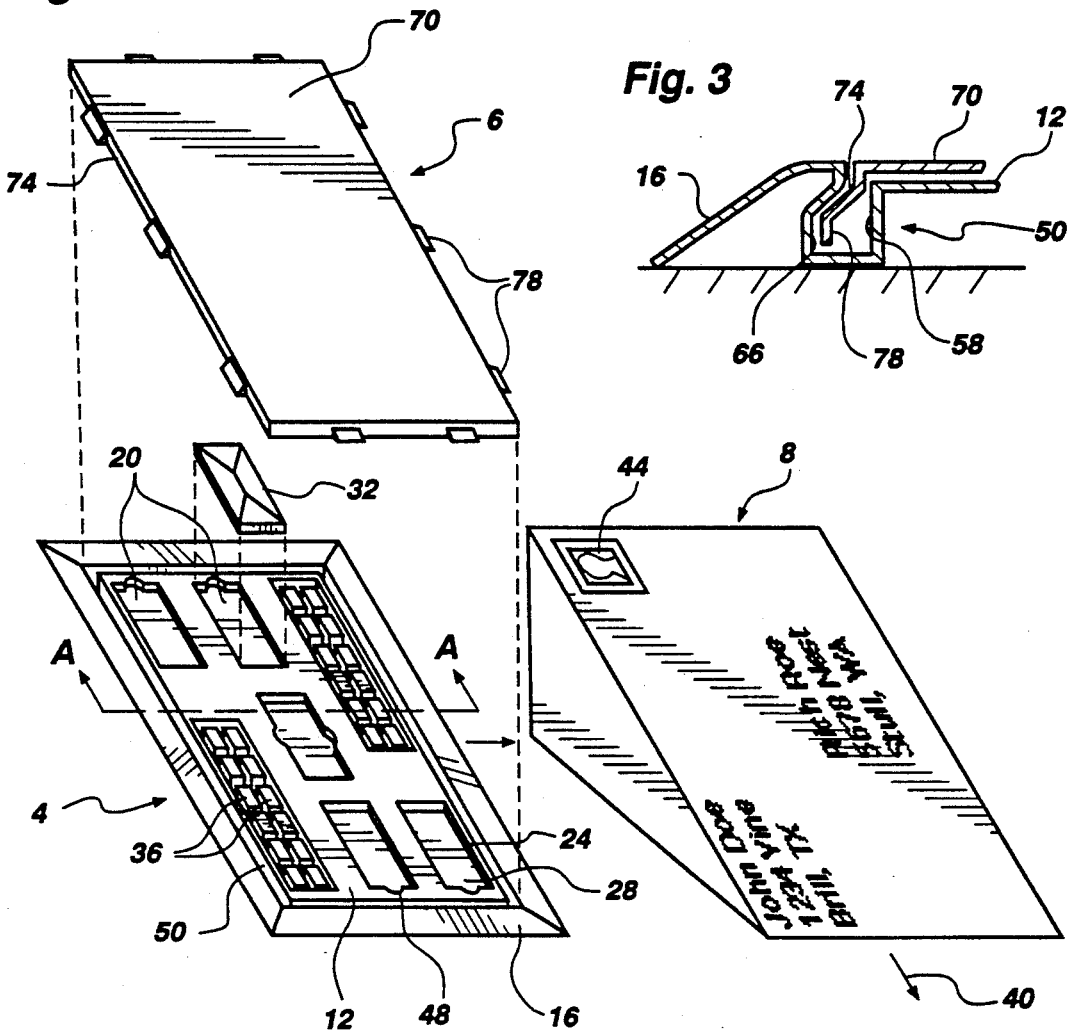
Fig. 3
Fig. 2
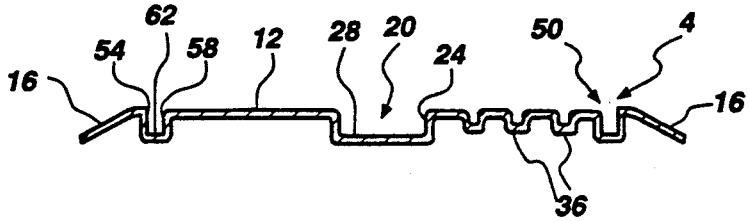

CONFECTION/GIFT HOLDING AND LID STRUCTURE FOR USE IN ENVELOPES

BACKGROUND OF THE INVENTION

This invention relates to a confection and gift holding tray and lid for securing confections and/or gifts in the tray, for use in conventional greeting card envelopes.

In U.S. Pat. No. 5,052,560, issued to applicant herein, a confection and gift holding structure was disclosed to include a generally planar sheet of material in which were formed a plurality of relatively shallow recesses for receiving and holding confections and/or gifts. The sheet of material, after the confections have been placed in the recesses, may then be fitted into a conventional greeting card envelope for mailing. This offers a novel alternative to conventional greeting cards since a gift as well as a message for the recipient can be sent in a conventional greeting card envelope, and can even be included with a conventional greeting card.

In the event that it is desired to send only the confection holding structure, without a greeting card, in a conventional greeting card envelope, ultimate removal of the confection holding structure as described in the aforecited patent could result in the confections falling from the holder. Even though this is only a minor inconvenience, it would be desirable to provide a confection holding structure which would serve to hold the confections in place until removed by the recipient.

SUMMARY OF THE INVENTION

It is an object of the invention to provide a confection/gift holding structure which fits within either a foldable greeting card or directly in a greeting card envelope, together with a lid structure for holding the confections in place in the holding structure.

It is also an object of the invention to provide such a holding and lid structure in which the lid may be removed and then replaced to hold any remaining confections/gifts in place and prevent them from falling out of the holding structure inadvertently.

It is a further object of the invention to provide such structure which both holds confections/gifts in place and allows viewing of the confections/gifts without the removal of the lid structure.

The above and other objects are realized in a specific illustrative embodiment of a mailing card/confection tray and lid which includes a tray having a generally planar upper surface formed with one or more relatively shallow wells for holding confections or gifts, and a relatively shallow groove which encircles the wells. The groove has facing sidewalls and a bottom wall, with indentations or slots formed in at least one of the sidewalls. A lid is provided which has a generally planar top and a downwardly projecting lip formed to follow a pathway which coincides with the pathway of the groove to allow insertion of the lip into the groove. The lip includes laterally projecting tabs which fit into the indentations or slots when the lid is placed on the tray with the lip disposed in the groove. The tray and lid are formed so that when the lid is in place on the tray, a low height profile is presented to allow insertion of the tray and lid into a conventional greeting card envelope.

In accordance with one aspect of the invention, the depth of the groove is substantially the same as the depth of the wells so that underside of the groove and wells generally define a plane to provide support for the tray and help in inhibiting flattening or crushing of the tray.

BRIEF DESCRIPTION OF THE DRAWINGS

The above and other objects, features and advantages of the invention will become apparent from a consideration of the following detailed description presented in connection with the accompanying drawings in which:

FIG. 1 is a perspective view of a confection/gift holding and lid structure for use in connection with greeting cards and/or greeting card envelopes, made in accordance with the principles of the present invention;

FIG. 2 is an end, cross-sectional view of the confection/gift holding and lid structure of FIG. 1, taken along lines A—A; and FIG. 3 is a fragmented, cross-sectional view of an edge of the confection/gift holding and lid structure, showing the mechanism for locking the lid structure onto the holding structure.

DETAILED DESCRIPTION

Referring to the drawings, there is shown a mailing card/confection tray 4 and lid 6 made in accordance with the present invention. The tray 4 and lid 6 are constructed to have a low, generally planar profile to allow insertion and use in connection with foldable greeting cards and greeting card envelopes, such as envelope 8. If used in conjunction with a greeting card, the tray 4, with the lid 6 secured thereon, would be inserted between the greeting card panels and then the card would be inserted into the envelope 8.

The tray 4 is formed from a sheet of material, such as polystyrene or other plastic, having a generally planar upper surface 12 (FIG. 2). The sheet of material is generally rectangular in shape and includes edges 16 which are tapered outwardly and downwardly, as best seen in FIG. 2. The tapered edges 16 allow for easy insertion of the tray 4 into the envelope 8 and also allow for more easy movement of an envelope containing a tray through a post office stamp cancelling machine.

Also formed in the sheet of material forming the tray 4 are a plurality of shallow recesses or wells 20, each having sidewalls 24 which extend downwardly from the upper surface 12, and a bottom wall 28 which is generally parallel with the upper surface 12, but disposed therebelow. These recesses define receptacles for receiving and holding confections or other items such as the package indicated at 32 (FIG. 1). When the package 32 is placed in a receptacle 20, the upper surface of the package 32 is substantially flush with the upper surface 12 of the tray to thus maintain the flat profile of the tray even though confections or packages are disposed therein.

In the embodiment of the tray of FIG. 1, two of the receptacles 20 are positioned in diagonally opposite corners of the tray, and three other receptacles are arrayed generally in a line coincident with the midline of the long dimension of the tray, between the receptacles located in the corners. Of course, various configurations could be employed for positioning the receptacles 20 in the tray 4.

To provide support for and prevent crushing of the receptacles 20, a plurality of downwardly extending protuberances or ridges 36 are formed in the tray 4. The depths of the ridges 36 are just less than or about the same as both the depths of the receptacles 20 and the distance downwardly which the tapered edges 16 extend. This is best seen in FIG. 2. The protuberances 36 are formed into two sets of mutually intersecting ridges which define a series of rectangles as shown. This configuration for the ridges has been found to provide desired support and crush resistance for the tray 4. The two sets of ridges 36 are positioned in diagonally opposite corners of the tray, as shown in FIG. 1. These locations for the sets of support ridges are beneficial since each receptacle 20 is adjacent to at least one set of ridges to thereby receive support from that set. Also, the positioning of the sets of support ridges as shown in FIG. 1 better protects against crushing of the receptacles when an envelope 8 with tray contained therein, is passed through a stamp canceling machine. The envelope 8 would pass through a stamp canceling machine in the direction indicated by the arrow 40 so that the set of support ridges of tray 4 located at the top of the envelope 8 would first be encountered by the stamp canceling machinery prior to the machinery reaching the location of the stamp 44 where a canceling impression would be applied.

Formed just inwardly of the tapered edges 16 is a downwardly extending groove or channel 50 which follows a rectangular pathway around the tray 4 just inside the tapered edges, but to encircle or circumscribe the receptacles 20 and support ridges 36. The channel 50 includes two facing sidewalls 54 and 58 (FIG. 2) and a bottom wall 62. The depth of the channel 50 is substantially the same as the depth of the receptacles 20 and the lower extension of the tapered edges 16, so that the underside of the channel, wells and tapered edges generally define a plane to support the tray.

Formed in the outer sidewall 54 of the channel 50, as best seen in FIG. 3, are a plurality of outwardly extending indentations or notches 66. Alternatively, open slots could be formed in place of the notches 66 and would serve the same purpose as will be discussed hereafter.

The lid 6 is formed with a rectangular perimeter having the same dimensions as those of the channel 50, and includes a generally planar upper or top section 7 and a lip 74 projecting downwardly from the periphery of the top section, as seen in FIG. 1. The lip 74 extends downwardly from around the entire periphery of the upper section 70, a distance just less than the depth of the channel 50. Projecting laterally outwardly from the lower edge of the lip 74 are a plurality of tabs 78, with three tabs being formed on each of the long sides of the lid 6 and two tabs being formed on each of the short sides, as shown. The notches 66 in the channel 50 are formed at the same locations in the rectangular periphery of the channel as are the tabs 78 in the rectangular periphery of the lid 6, so that when the lid is placed on the tray 4, and the lip 74 inserted into the channel 50, the tabs 78 will fit or register in a corresponding notches to thereby hold the lid in place on the tray.

The border 16 of the tray 4 is formed at a slightly higher elevation than the upper surface 12 (FIG. 2) so that when the lid 6 is put in place on the tray with the lip 74 disposed in the channel 50, the top surface of the upper section 70 of the lid will be at substantially the same elevation as the uppermost part of the border 16 (see FIG. 3). Thus, even with the use of the lid 6, the low, flat profile of the confection holder is maintained.

Advantageously, the lid 6 is formed of a transparent material to allow viewing the contents of the tray without removing the lid. For example, the lid 6 may be made of clear polyvinyl chloride, with a thickness of about 10 mils which provides some rigidity to the lid but allows it to be manipulated for placement on and removal from the tray 4. Other materials could also be used, however.

The tray 4 is constructed of a material which, although flexibly bendable, is also substantially rigid in the plane of the tray, i.e., the material of the tray cannot be readily stretch or compressed. Polystyrene and other plastics provide this characteristic.

The tray 4 and the lid 6 might each be constructed from a single piece of material by thermal forming, and thus can be readily mass produced on a fairly economical basis. It has been found that the process of thermal forming the tray 4 is facilitated by spacing the notches 66 some distance from the corners of the rectangular periphery of the channel 50, otherwise the molding machine tends to deform the tray when the tray is pulled from the mold. Thus both the notches 68 and tabs 78 are spaced some distance away from the corners of the tray and lid respectively. This spacing also aids in more securely holding the lid on the tray.

With the configuration described above, confections or gifts may be placed in the tray 4 and then the lid 6 placed on the tray, to securely hold the confections or gifts in place both before inserting the tray and lid in an envelope and after removal from the envelope. Provision of the lip 74 on the lid 6, with notches 78 to mate and register in notches 66 of the channel 50, allow for holding the lid securely in place on the tray.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A confection/gift holding structure for disposition in envelopes comprising a base including a generally planar sheet of material having a plurality of relatively shallow recesses formed in one surface thereof to define open receptacles for receiving and holding confections/gifts, and having a channel in said one surface disposed to circumscribe said recesses, said channel having a bottom wall and facing sidewalls, with notches formed in at least one of the sidewalls of the channel, and a generally flexible planar lid whose perimeter is formed to overlie the channel when the lid is placed on the base, said lid including a lip projecting downwardly from the perimeter to fit in the channel and allow the lid to lie flat on said one surface, said lip including laterally projecting tabs which fit into respective notches in the channel to hold the lid in place on the base.

2. A structure as in claim 1 wherein the notches are formed in the outermost sidewall of the channel, and wherein the tabs project laterally outwardly of the lip to fit in the notches when the lid is placed on the base.

3. A structure as in claim 1 wherein the base is generally rectangular to fit within a mail envelope, wherein the channel extends in a generally rectangular path spaced inwardly a substantially uniform distance from the periphery of the base, wherein the lid is generally rectangular with substantially the same dimensions as the channel path, and wherein the notches and tabs are spaced predetermined distances from the corners of the channel and lid respectively.

4. A structure as in claim 3 wherein the short sides of the rectangular path of the channel and the short sides of the lid include two notches and tabs respectively, and wherein the long sides of the rectangular path of the channel and the long sides of the lid include three notches and tabs respectively.

5. A structure as in claim 1 wherein the lid is made of a transparent material.

6. A structure as in claim 5 wherein the lid is made of polyvinyl chloride and has a thickness of at least 10 mils.

7. A structure as in claim 1 wherein said base includes a border disposed laterally outside of the channel and having an upper surface which is slightly higher than said one surface, so that when the lid is in place on the base, with the lip inserted in the channel, the top surface of the lid is generally at the same height as that of the upper surface of the border.

8. A mailing card/confection tray and lid for insertion in a mailing envelope comprising a tray having a generally planar upper surface formed with one or more relatively shallow wells for holding confections/gifts, and a relatively shallow groove which encircles the wells, said groove having facing sidewalls with indentations/slots formed in at least one of the sidewalls, and a lid having a generally planar top and a downwardly projecting lip formed to follow a pathway which coincides with the pathway of the groove to allow insertion of the lip in the groove, said lip including laterally projecting tabs which fit into the indentations/slots when the lid is placed on the tray with the lip disposed in the groove.

9. A mailing card/confection tray and lid as in claim 8 wherein the depth of the groove is substantially the same as the depth of the wells so that the underside of the groove and wells generally define a plane.

10. A mailing card/confection tray and lid as in claim 8 wherein the tray is generally rectangular, wherein the groove follows a generally rectangular pathway spaced a generally uniform distance inwardly from the periphery of the tray to define a border between the groove and periphery, wherein the lid is generally rectangular, and wherein the lip follows a generally rectangular pathway coincident with the pathway of the groove.

11. A mailing card/confection tray and lid as in claim 10 wherein the upper surface of the border is higher than the upper surface of the tray so that when the lid is in place on the tray with the lip inserted in the groove, the upper surface of the border is generally at the same elevation as the top surface of the lid.

12. A mailing card/confection tray and lid as in claim 10 wherein the indentations/slots are formed in the outermost sidewall of the groove, and wherein the tabs project laterally outwardly from the lip to fit in the indentations/slots when the lid is placed on the tray.

13. A mailing card/confection tray and lid as in claim 12 wherein the indentations/slots and tabs are spaced selected distances from the corners of the groove pathway and lip pathway respectively.

14. A mailing card/confection tray and lid as in claim 13 wherein the rectangular dimensions of the tray are less than those of a mail envelope to enable insertion of the tray into the mail envelope, wherein the short sides of the rectangular pathways of the groove and lip include two or more indentations/slots and tabs respectively, and wherein the long sides of the rectangular pathways of the groove and lip include three or more indentations/slots and tabs respectively.

15. A mailing card/confection tray and lid as in claim 8 wherein said lid is made of a transparent material.

16. A mailing card/confection tray and lid as in claim 15 wherein said lid is constructed of polyvinyl chloride and has a thickness of about 10 mils.

* * * * *